US005531500A

United States Patent [19]

Podvin

[11] Patent Number: 5,531,500

[45] Date of Patent: Jul. 2, 1996

[54] PROTECTIVE SHIELD FOR VEHICLE DOOR

[76] Inventor: Richard T. Podvin, 1391 Mississippi St. NE., Fridley, Minn. 55432

[21] Appl. No.: 286,459

[22] Filed: Aug. 5, 1994

[51] Int. Cl.[6] ..... F41H 7/00

[52] U.S. Cl. ..... 296/152; 49/501; 89/36.02; 89/36.08; 52/787.12; 109/49.5; 109/83; 109/84; 280/770; 293/128; 296/188; 296/191; 428/911

[58] Field of Search ..... 296/191, 152, 296/146.5, 188, 146.6, 136; 293/128; 89/36.02, 36.08, 36.09, 36.07, 36.11, 36.12; 49/501, 502; 52/309.13, 309.1, 785, 811; 428/911; 109/49.5, 80, 82, 83, 84, 85; 280/770

[56] References Cited

U.S. PATENT DOCUMENTS

| | | | |
|---|---|---|---|
| 2,363,573 | 11/1944 | Costa | 89/36.08 |
| 3,112,951 | 12/1963 | Deer | 296/152 |
| 3,369,836 | 2/1968 | Haycock et al. | 296/78.1 |
| 3,540,773 | 11/1970 | Settle, Jr. et al. | 296/152 |
| 3,855,898 | 12/1974 | McDonald | 296/146 |
| 3,866,242 | 2/1975 | Slagel | 161/165 |
| 3,903,224 | 9/1975 | Billiu | 296/901 |
| 4,316,404 | 2/1982 | Medlin | 89/36 H |
| 4,413,357 | 11/1983 | Sacks | 2/2.5 |
| 4,531,560 | 7/1985 | Balanky | 293/128 X |
| 4,546,863 | 10/1985 | Kaufman | 190/102 |
| 4,643,477 | 2/1987 | Kovatch | 296/84 K |
| 4,732,803 | 3/1988 | Smith, Jr. | 428/212 |
| 4,810,015 | 3/1989 | McNeil | 293/128 |
| 4,842,923 | 6/1989 | Hartman | 428/219 |
| 4,879,165 | 11/1989 | Smith | 428/212 |
| 5,200,256 | 4/1993 | Dunbar | 109/49.5 X |
| 5,271,311 | 12/1993 | Madden, Jr. | 89/36.08 |
| 5,326,606 | 7/1994 | Labock | 428/911 X |

OTHER PUBLICATIONS

J. C. Whitney & Co., Parts and Accessories, Catalog No. 466B, p. 49.

*Primary Examiner*—David M. Mitchell
*Assistant Examiner*—Kai M. Robinson
*Attorney, Agent, or Firm*—Haugen and Nikolai

[57] ABSTRACT

A bullet-proofing panel for attachment to the exterior door surfaces of a police cruiser or the like comprising an outer polymeric skin having a contour corresponding to the contour of the sheet metal of the vehicle's doors. The polymeric skin member when affixed to the outer sheet metal panels of the vehicle's doors defines a predetermined space or pocket therebetween which contains a barrier member, preferably a woven KEVLAR® material, capable of stopping bullets from practically all handguns. Because the outer polymeric skin can be shaped to follow the contours of the original vehicle and painted to match, the bullet-proof panel does not detract from the overall ornamental appearance of the vehicle.

10 Claims, 1 Drawing Sheet

PROTECTIVE SHIELD FOR VEHICLE DOOR

FIELD OF THE INVENTION

This invention relates generally to apparatus for protecting police patrolmen and others, and more particularly to a bullet-resistant shield attachable to the exterior door surfaces of a police cruiser to prevent penetration of the door by bullets fired from handguns.

DISCUSSION OF THE PRIOR ART

With the rising levels of violence and the widespread availability of handguns, police officers are frequently exposed to danger from shootings as they carry out their normal patrol duties. It has been found that most handguns are capable of firing a bullet that can readily pass through the outer sheet metal and the inner decorative fabric covering on the doors of automobiles used as police vehicles and with sufficient momentum to injure or kill an officer who happens to be in the path of travel of that bullet.

In U.S. Pat. No. 5,271,311 to Madden, Jr., there is disclosed a bullet-resistant panel that is designed to be attached to the inside of the front doors of a motor vehicle. The panel comprises a plurality of layers of woven aramid fibers such as KEVLAR® 29 and KEVLAR® 49 manufactured by E. I. du Ponte de Neumours & Company and which have been used in the past for creating bullet-proof vests and the like.

In a similar fashion, U.S. Pat. No. 3,855,898 to McDonald also teaches the idea of providing a bullet-proof panel adapted to attach to the inside of a vehicle door for prevent bullets from entering the vehicle. Locating a bullet-proofing panel on the inside of the vehicle door is disadvantageous from the standpoint of access to the door handle and window crank. In an emergency situation, it often becomes necessary to bail out of the automobile quickly and with a bullet-proofing panel overlaying the inside door handle and the window crank, precious time is lost in finding the flap-covered opening provided to allow access to these components. Moreover, a bullet piercing through the vehicle's door and then impinging upon the bullet-proofing panel will tend to push the bullet-proofing panel inward and if that panel is not securely attached to the inside of the vehicle door, it can be forced against a vehicle occupant. With a bullet-proofing panel on the exterior surface of the door, however, rapid access to the inside door handle and the window crank is not interfered with and the force of a bullet striking the bullet-proofing panel will be spread over the sheet metal of the original door.

SUMMARY OF THE INVENTION

In accordance with the present invention, there is provided a bullet-proof panel adapted to be attached to the exterior sheet metal surface of a vehicle door for rendering the door bullet-proof. The panel comprises an outer polymeric skin, preferably fabricated from LEXAN®, which is a polycarbonate resin molding material manufactured by General Electric Corporation, or from fiberglass, which is designed to have the same contour as the underlying sheet metal door panel and which is finished and painted so as to be almost indistinguishable from the original sheet metal door panel. When the outer polymeric skin is affixed to the vehicle door, a pocket or void exists between the two and this pocket is filled with a bullet-proof barrier member such as plural layers of woven KEVLAR® fibers.

It has been found that the bullet-proof panel constructed in accordance with the present invention is able to prevent penetration of bullets fired from handguns through a vehicle door. It is not, however, capable of stopping bullets fired from high-powered rifles.

DESCRIPTION OF THE DRAWINGS

The foregoing features, objects and advantages of the invention will become apparent to those skilled in the art from the detailed description of a preferred embodiment, especially when considered in conjunction with the accompanying drawings in which like numerals in the several views refer to corresponding parts.

DESCRIPTION OF THE PREFERRED EMBODIMENT

Figure 1:
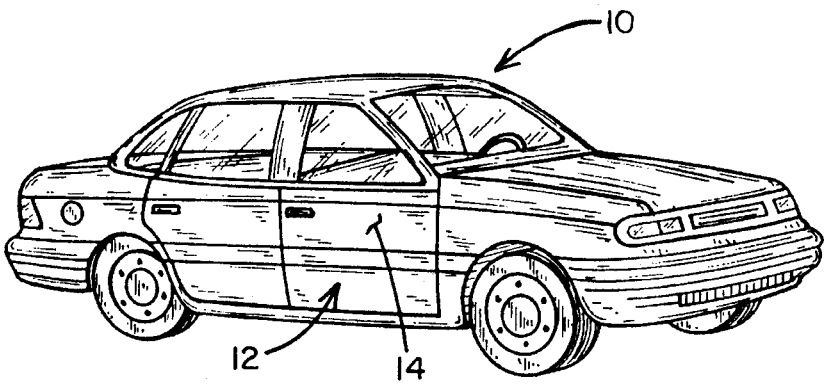
FIG. 1 is a perspective drawing of an automobile with the bullet-proof panel of the present invention affixed to the front driver side door and the front passenger door thereof.

In FIG. 1, there is shown an automobile equipped with the bullet-resistant panels constructed in accordance with the present invention. More particularly, the front passenger side entry door 12, as well as the driver side door (not shown), has affixed to it a bullet-resistant panel 14.

Figure 3:
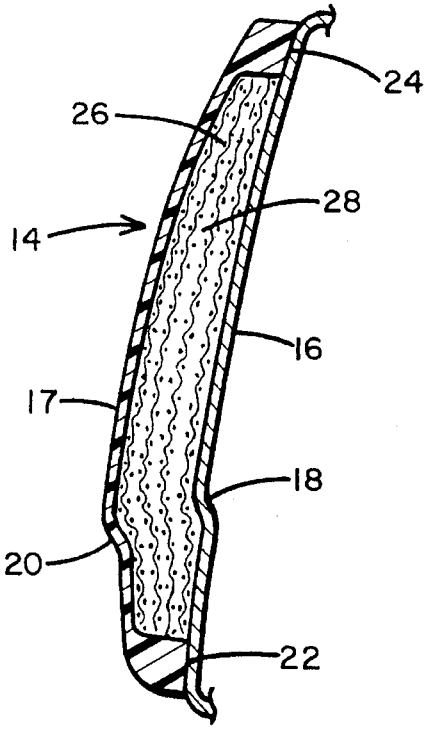
FIG. 3 is a cross sectional view taken along the line 3—3 in FIG. 2, where the exterior of the bullet-proof panel is formed from fiberglass.
Figure 2:
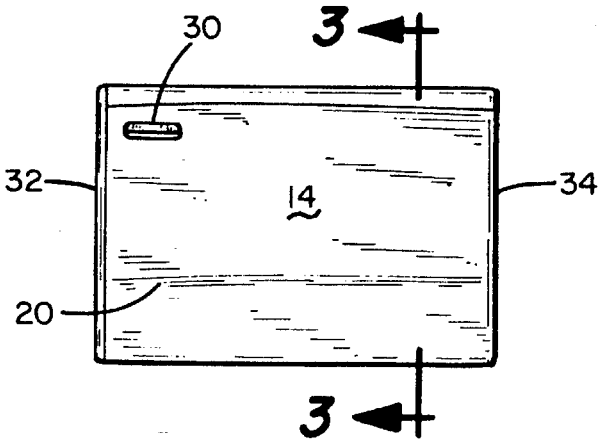
FIG. 2 is a front view of the bullet-proof panel constructed in accordance with the present invention.

With reference next to FIGS. 2 and 3, the constructional features of the bullet-proof panel will be described. Identified by numeral 16 is the original sheet metal skin comprising the exterior of the vehicle door. The door is, of course, styled to blend with the remainder of the vehicle 10. For example, the sheet metal 16 may be formed as at 18 to create a desired ornamental appearance.

Figure 4:
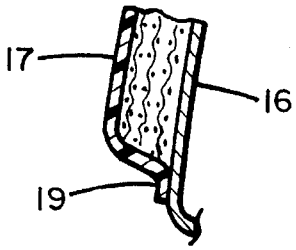
FIG. 4 is a cross-sectional view taken along the line 3—3 in FIG. 2 where the exterior of the bullet-proof panel is formed from LEXAN® plastic sheet material.

Affixed to the sheet metal panel 16 of the door 12 is an outer skin 17 which is preferably formed from LEXAN® plastic or fiberglass and which is shaped in a vacuum forming process to conform closely to the styling of the underlying sheet metal panel 18. For example, the polymeric skin 17 is indented at 20 to correspond to the bend 18 made in the original sheet metal panel 16. The perimeter of the skin 17 using fiberglass construction is considerably thicker in dimension than the central portion thereof, providing a predetermined surface area, as at 22 and 24 in FIG. 3, where the outer skin 17 may be adhesively bonded to the underlying sheet metal panel 16 of the door. The partial cross-sectional view of FIG. 4 shows how the exterior polymeric skin 17 may be bent to form a flange area 19 proximate its perimeter to allow attachment to the underlying sheet metal panel 16 of the vehicle's door when the polymeric skin comprises a sheet of LEXAN plastic. This flange 19 again provides a surface allowing an adhesive bonding material to secure the panel to the door.

Irrespective of whether the outer polymeric panel is fabricated from fiberglass or LEXAN®, a pocket or space 26 between the fiberglass skin 17 and the door's sheet metal panel is provided. This pocket 26 is filled with a suitable bullet-resistant material. A woven KEVLAR® aramid fiber material 28 is preferred.

While KEVLAR® woven aramid fiber fabric is a preferred bullet-proof barrier medium useful in carrying out the present invention, other materials that may prove suitable include a polyethylene fabric such as Spectra 900 and Spectra 1000 sold by Allied Signal Corporation of Morristown, N.J. It is also contemplated that the bullet-proof barrier layer contained in the pocket of the outer fiberglass skin may be one of the ballistic resistant materials described in the Hartman U.S. Pat. No. 4,842,943, the teachings of which are incorporated by reference herein.

To accommodate and provide access to the car door handle and the key lock on the door, a cut-out 30 (FIG. 2) is provided through the panel 14 and the borders of the fiberglass or LEXAN® sheet defining the cut-out 30 are inwardly curved to contact the underlying sheet metal so that no sharp edges are present. Likewise, the left and right edges 32 and 34 are smoothly contoured so as to flow into the adjacent sheet metal of the automobile to yield a smooth, aesthetically pleasing transition.

By way of example only, the fiberglass or LEXAN® skin need only be about ⅛ inch thick over the majority of its surface area and about ⅜ inch thick about its perimeter to thereby provide a pocket approximately ¼ inch thick for receiving the woven KEVLAR® fabric therein. The thickened perimeter of the fiberglass skin 17 may be approximately ¾ inch in width which provides ample area of contact so that adhesive bonding can be used to affix the panel to the vehicle door. Tests have shown that the bullet-resistant panel constructed as indicated is sufficient to prevent penetration of the door by bullets fired from 22 caliber, 380 caliber, 9 mm, 357 magnum and 44 magnum pistols.

The above described principles may be used to install light weight armor on the exterior door surfaces of automobiles used by police or others that may be exposed to an unreasonable risk of harm from gunshot wounds during the course of their work. Because the bullet-proofing panels can be made very thin and of a material that can be molded, sanded and spray painted to match the contours and color of the remainder of the vehicle, the presence of the bullet-proofing structure does not detract from the desired appearance of the vehicle.

While several embodiments have been described herein, it will be appreciated that modifications of these particular embodiments of the invention may be devised by persons skilled in the art without from departing from the scope of the invention as defined by the following claims.

What is claimed is:

1. A bullet-proof panel for an automotive vehicle, said vehicle having a body and a plurality of doors hinged to said body to allow driver and passenger ingress and egress, said doors having outer sheet metal panels contoured for style, the bullet-proof panel comprising:

a) an outer polymeric skin having an external surface and an internal surface, each of said external and internal surfaces having a contour corresponding to the contour of said outer sheet metal panels, said internal surface having a heightened stand-off portion integrally disposed about the periphery of said internal surface, said stand-off portion extending generally perpendicularly away from the plane defined by said internal surface to define a central pocket in said outer polymeric skin;

b) means for affixing said stand-off portion of said outer polymeric skin to said outer sheet metal panels; and c) a bullet-proof barrier member disposed in said central pocket of said outer polymeric skin substantially co-extensive with said outer sheet metal panels of said plurality of doors.

2. The bullet-proof panel as in claim 1 wherein said outer polymeric skin is made of fiberglass.

3. The bullet-proof panel as in claim 1 wherein said outer polymeric skin is made of LEXAN® plastic.

4. The bullet-proof panel as in claim 1 wherein said bullet-proof barrier member is a woven material of aramid fibers.

5. The bullet-proof panel as in claim 1 wherein said bullet-proof barrier member comprises a woven mat of KEVLAR® fibers.

6. The bullet-proof panel as in claim 1 wherein said means for affixing is an adhesive disposed between said stand-off portion of said outer polymeric skin and said outer sheet metal door panels.

7. A bullet-proof panel for an automotive vehicle, said vehicle having a body and left and right doors hinged to said body to allow driver and passenger ingress and egress respectively, said doors each having an outer sheet metal panel with an exterior surface for style, and a handle for opening and closing same, comprising:

a) an outer molded plastic skin having a contour and a periphery matching that of said sheet metal panel, said plastic skin being curved about said periphery to define a central pocket therewithin, said plastic skin being attached to the exterior surface of said outer sheet metal panel to enclose said central pocket with said exterior surface of said sheet metal panel, said central pocket being generally co-extensive with said sheet metal panel; and b) a woven mat of KEVLAR® aramid fibers of a predetermined thickness filling said central pocket.

8. The bullet-proof panel as in claim 7 wherein said plastic skin includes an opening for surrounding said handle.

9. The bullet-proof panel as in claim 8 wherein said plastic skin is fiberglass.

10. The bullet-proof panel as claim 8 wherein said plastic skin is LEXAN® plastic.

* * * * *